US007690903B2

(12) United States Patent
Norgaard et al.

(10) Patent No.: US 7,690,903 B2
(45) Date of Patent: Apr. 6, 2010

(54) FORMING HEAD AND PROCESS FOR THE PRODUCTION OF A NON-WOVEN FABRIC

(75) Inventors: Raymond Norgaard, Neudorf (DE); Morten Rise Hansen, Vodskov (DK)

(73) Assignee: CONCERT GmbH, Falkenhagen (DE)

( * ) Notice: Subject to any disclaimer, the term of this patent is extended or adjusted under 35 U.S.C. 154(b) by 155 days.

(21) Appl. No.: 11/587,108

(22) PCT Filed: Apr. 29, 2005

(86) PCT No.: PCT/EP2005/051971

§ 371 (c)(1),
(2), (4) Date: Dec. 17, 2007

(87) PCT Pub. No.: WO2005/106091

PCT Pub. Date: Nov. 10, 2005

(65) Prior Publication Data

US 2008/0241301 A1 Oct. 2, 2008

(30) Foreign Application Priority Data

Apr. 29, 2004 (EP) ..... 10 2004 021 453

(51) Int. Cl.
*D01G 19/20* (2006.01)

(52) U.S. Cl. ..... 425/82.1; 425/83.1; 19/296; 19/306

(58) Field of Classification Search ..... 425/80.1–83.1, 425/401; 19/301–306
See application file for complete search history.

(56) References Cited

U.S. PATENT DOCUMENTS 3,731,685 A 5/1973 Chatterjee
4,650,409 A * 3/1987 Nistri et al. ..... 425/82.1
4,708,900 A 11/1987 Siegers et al. ..... 428/74
6,233,787 B1 * 5/2001 Eriksen et al. ..... 425/82.1
7,480,966 B2 * 1/2009 Celli ..... 19/304
7,491,354 B2 * 2/2009 Andersen ..... 425/82.1

FOREIGN PATENT DOCUMENTS

EP 0 159 618 A 10/1985
EP 0163891 A1 12/1985
EP 0 301 874 A 2/1989
EP 1 299 588 B1 5/2001
WO WO 99/36623 A 7/1999
WO WO 03/016605 A1 8/2002
WO WO 03/086709 A1 12/2002

OTHER PUBLICATIONS

The State Intellectual Property Office of China; "First Notification of Office Action"; whole document; Jun. 5, 2009; English translation only.

* cited by examiner

*Primary Examiner*—Richard Crispino
*Assistant Examiner*—Thu Khanh T Nguyen
(74) *Attorney, Agent, or Firm*—Ware, Fressola, Van Der Sluys & Adolphson LLP

(57) ABSTRACT

The invention concerns a forming head for an apparatus for the production of a non-woven fabric by depositing fibers on a conveyor belt, comprising a fiber feeder which opens into a fiber processing chamber and which has a lower deposit opening for the delivery of fibers, wherein arranged in the fiber processing chamber are interengaging needle rollers with longitudinal axes oriented in mutually parallel relationship, which can rotate about their respective longitudinal axis, and the interengaging needle rollers enclose an inner chamber and are arranged with respect to the fiber feeder and the deposit opening in such a way that fibers fed to the forming head in operation enter the inner chamber by passing through between interengaging needle rollers and leave the inner chamber also by passing through between interengaging needle rollers.

18 Claims, 2 Drawing Sheets

FORMING HEAD AND PROCESS FOR THE PRODUCTION OF A NON-WOVEN FABRIC

CROSS REFERENCE TO RELATED APPLICATIONS

This application is for entry into the U.S. national phase under §371 for International Application No. PCT/EP05/051971 having an international filing date of Apr. 29, 2005, and from which priority is claimed under all applicable sections of Title 35 of the United States Code including, but not limited to, Sections 120, 363 and 365(c), and which in turn claims priority under 35 USC §119 to German Patent Application No. DE 10 2004 021 453.0-26 filed on Apr. 29, 2004.

BACKGROUND OF THE INVENTION

1. Technical Field

The invention concerns the production of fabric, and more particularly, the production of non-woven fabric.

2. Discussion of Related Art

The invention concerns on the one hand a forming head for an apparatus for the production of a non-woven fabric and on the other hand a process for processing fibres for the production of a non-woven fabric. The forming head has at least one fibre feed means which opens into a fibre processing chamber. The fibre processing chamber has a deposit opening for the delivery of fibres for example on to a conventional, air-permeable conveyor belt, below which is arranged a so-called suction box. A plurality of needle rollers which engage into each other, with longitudinal axes oriented in mutually parallel relationship, are arranged in the fibre processing chamber. The needle rollers are rotatable about their longitudinal axis.

Accordingly the process includes as process steps the feed of fibres to a forming head and the uniform distribution of the fibres on a conveyor belt by means of the forming head.

Forming heads and processes of that kind are already known in various different forms, thus for example from WO 99/36623 or WO 03/016605.

The non-woven fabrics to be produced usually contain a mix of natural fibres, for example cellulose fibres of cotton or loosened wood cellulose which has already been treated mechanically and/or chemically (fluff pulp), synthetic matrix fibres such as for example polyester, polypropylene or viscose as well as synthetic binding fibres such as for example so-called bi-component fibres as well as for example as absorption agents so-called super-absorbent polymers in particle form (SAP) or fibre form (SAF). Bi-component fibres usually have a core melting at elevated temperatures (190-250° C.) of for example polypropylene (PP) or polyethylene-terephthalate (PET) which are enclosed by a sheath which melts at lower temperatures (140° C.) and which comprises for example polyethylene (PE), or are connected in another form (side-by-side, fibril type).

Non-woven fabrics of that kind are used for example as a semimanufactured article for the production of diapers and sanitary towels, absorbent inserts for the foodstuffs industry or for insulating material.

An important process step in the production of such a non-woven fabric is for the fibre mix to be deposited as uniformly as possible on an air-permeable transport or conveyor belt. That deposit operation is effected by means of a forming head in which the fibres are mixed. The deposit operation is assisted by a suction device (suction box) beneath the conveyor belt, with which the fibres are sucked through the air-permeable conveyor belt towards the conveyor belt.

The fibre mixes which are deposited in an admittedly tangled but uniform form are transported on the conveyor belt in the form of a fibre bed for further processing in subsequent process steps, for example the effect of heat on the fibre bed, so that the polyethylene sheaths of the bi-component fibres fuse together and stick together. Treatment with latex can also be effected. In addition it is possible for a plurality of fibre bed layers to be deposited one upon the other in order in that way for example to produce a multi-layer non-woven fabric or also only a thicker non-woven fabric.

The range of variations in the products which can be produced with conventional apparatuses and processes is usually restricted by virtue of the fact that only given kinds of fibres or fibre lengths are to be processed therewith, so that the known processes and apparatuses cannot be used to produced non-woven fabrics which contain both relatively short fibres and also relatively long fibres, in one forming step. The state of the art includes installations in which the deposit of the short and long fibres takes place in succession (EP 1 299 588) or with a card (WO 03/086709). Disadvantages here are the increased level of machine complication and expenditure and the low weights in relation to surface area which can be achieved, if the fibres are provided by way of a carding process.

Therefore the object of the invention is to provide an apparatus and a process which have a greater range of variations in respect of the fibres to be processed and thus in respect of the products to be manufactured.

DISCLOSURE OF INVENTION

According to the invention that object is attained by a forming head of the kind set forth in the opening part of this specification, in which the interengaging needle rollers enclose an inner chamber and are arranged with respect to the fibre feed means and the deposit opening in such a way that fibres which are fed to the forming head in operation pass through between interengaging needle rollers into the inner chamber and also leave the inner chamber between interengaging needle rollers. The forming head is accordingly of such a configuration that the fibres to be processed have to pass through between interengaging needle rollers at least twice and preferably a plurality of times on the way from the respective fibre feed means to the deposit opening. In that situation, the interengaging needle rollers contribute in duplicate relationship to rendering the distribution of fibres uniform. On the one hand they simply cause fibres which have already been separated off individually to be distributed uniformly. Added to that is the fact that the interengaging needle rollers break up fibre lumps comprising fibres which are hooked together, and in that way provide for further fibre separation. The latter operation can also be referred to as fibre opening. In that sense the forming head according to the invention has a greater fibre opening capacity than known forming heads. A further advantage is that both long natural fibres, for example cotton cellulose fibres, and also short natural fibres, for example wood cellulose fibres, or also synthetic fibres, can be processed with the forming head according to the invention equally and in one step, in particular fibres of lengths of between 2 and 60 mm. Fibre beds of between for example 50 g/m$^2$ and 2500 g/m$^2$ can also be produced in one step with the forming head according to the invention. Hitherto, different apparatuses and processes were required for processing fibres of such different lengths. Thus for example long-fibre fibre beds of 10 g/m$^2$ to 80 g/m$^2$ can be produced in one step with conventional forming heads, while short-fibre beds of 50 g/m$^2$ to 2000 g/m$^2$ can be produced with the conventional air placement process.

In a preferred embodiment the longitudinal axes of the needle rollers are connected to the needle roller carrier which is driven in rotation and the axis of rotation of which extends parallel to the longitudinal axes of the needle rollers. In that way it is possible for the needle rollers to be caused to perform not only a rotary movement but also a translatory movement. In that case, the needle rollers are preferably each at the same spacing relative to the axis of rotation of the needle roller carrier and are thus arranged on a notional cylindrical wall belonging to a cylinder, the centre line of which is the axis of rotation of the needle roller carrier. The needle rollers are also distributed uniformly on that notional cylinder wall so that they are each at the same spacing from each other. The fibres which pass into and out of the inner chamber thus pass through the needle rollers which are rotating and at the same time moving with a translatory movement.

In that respect the rotary movement of the needle rollers is preferably such that mutually adjacent needle rollers rotate in a mutually opposite direction of rotation, just as that also applies for meshing gears of a transmission. However in a preferred embodiment the interengaging needle rollers are not coupled together rigidly, for example by way of gears, but each have their own respective separate drive and can therefore also be driven for example at different speeds of rotation. For that purpose the needles of adjacent needle rollers are displaced relative to each other with respect to the direction of the longitudinal axis of the needle rollers so that needles of adjacent needle rollers do not collide, irrespective of the respective rotary speeds. The needles are preferably arranged on the needle rollers in longitudinal rows, more specifically particularly preferably alternately displaced a little in the peripheral direction of the needle roller, thus affording in each case a row of needles in a zig-zag shape. In that arrangement, the needles of the individual needle rollers each project from a cylindrical needle roller body to which the individual needles are fixed.

In principle the number of the needle rollers enclosing a respective inner chamber is any number and is at least 4. An arrangement of 8 or 12 needle rollers however has the advantage that the transport direction in the intermediate space between the needle rollers, which is predetermined by the rotary movement of adjacent needle rollers in different directions of rotation, is such that the transport direction in mutually opposite intermediate spaces is respectively opposite, that is to say is directed either towards each other (into the inner chamber) or away from each other (out of the inner chamber). The needle roller carrier normally has a central shaft which is oriented concentrically with respect to the axis of rotation of the needle roller carrier and thus on the one hand at least partly fills a part of the inner chamber, and on the other hand also serves for the transmission of rotational forces along the shaft.

The fibre processing chamber of the forming head preferably has in the region of the needle rollers side and end walls which surround the needle rollers enclosing the inner chamber, in such a way that fibres are very substantially prevented from flowing past the inner chamber outside the needle rollers. In addition the side walls which extend in parallel relationship with the axis of rotation and the longitudinal direction of the needle rollers, above the inner chamber, are preferably curved towards each other in such a way that there is a fibre entry opening which is constricted in relation to the outer diameter of the assembly of the needle rollers enclosing the inner chamber. That fibre entry opening is preferably of such a dimension that it corresponds approximately to 1.5 to 2.5 times the free space which is present between rollers bodies of mutually adjacent needle rollers. A fibre entry opening of that kind contributes to making a stream of fibres and also an air flow through the inner chamber more uniform. In that case the fibre entry opening is preferably arranged centrally above the inner chamber so that the fibres are fed as centrally as possible to the rotating needle rollers which mesh with each other and which are moved with a translatory movement.

Preferably a sieve is arranged beneath the inner chamber and is associated with the deposit opening. That sieve preferably extends along a notional cylinder wall segment corresponding to a notional cylinder whose centre line is the axis of rotation of the needle roller carrier.

When using longer fibres of a length of 10 to 60 mm, the sieve is preferably formed by sieve bars which extend at least approximately parallel to each other and to the longitudinal axes of the needle rollers and which are preferably of a round cross-section. The cross-section of the sieve bars is preferably so selected that, in diameter, it corresponds approximately to half the fibre length of the longest fibres to be processed. The spacing of the sieve bars from each other also preferably corresponds to half the fibre length of the longest fibres to be processed. A sieve of that kind acts as a diffuser in the aerodynamic sense and thus contributes to making the air flow uniform within the inner chamber. Thus, for a fibre bed deposited on the conveyor belt, that affords a uniform air flow between the fibre feed means for the fibres to be processed, and the suction box beneath the conveyor belt.

When using shorter fibres of a length of up to 10 mm the sieve is formed by wire mesh grids or steel plates which have long been known, with regular repetitive geometrical openings. The opening shapes can be round, stadium-shaped (oval) or rectangular. Their number, size and arrangement is dependent on the desired degree of opening, being the relationship between the total surface area of the sieve and the through-passage surface area.

In accordance with the apparatuses described hitherto the above-specified object is also attained by a process of the above-indicated kind, in which not only distribution of the fibres which have already been separated but also opening of fibre lumps and thus individual separation of fibres is effected in the forming head, more specifically by means of rotating, interengaging needle rollers. In that case the fibres are guided through between rotating and interengaging needle rollers into an inner chamber and then leave that inner chamber by passing through between rotating, interengaging needle rollers.

For that purpose the needle rollers are preferably moved transversely with respect to the direction of rotation of the needle rollers during the feed of the fibres to the inner chamber. The movement of the needle rollers (rotary movement and translatory movement) is preferably so set that the fibres or at least a part of the fibres are fed to the inner chamber a plurality of times before the fibres leave a fibre processing chamber in which the inner chamber is disposed.

In addition, for carrying out the process, preferably an air flow is produced, which passes from above downwardly through the inner chamber. That air flow is preferably rendered uniform by a sieve beneath the inner chamber. In addition the air flow is preferably passed above the inner chamber through a fibre entry opening which is constricted in relation to the inner chamber. That also contributes to making the air flow uniform.

The invention will now be described in greater detail by means of an embodiment by way of example.

DETAILED DESCRIPTION

Figure 1:
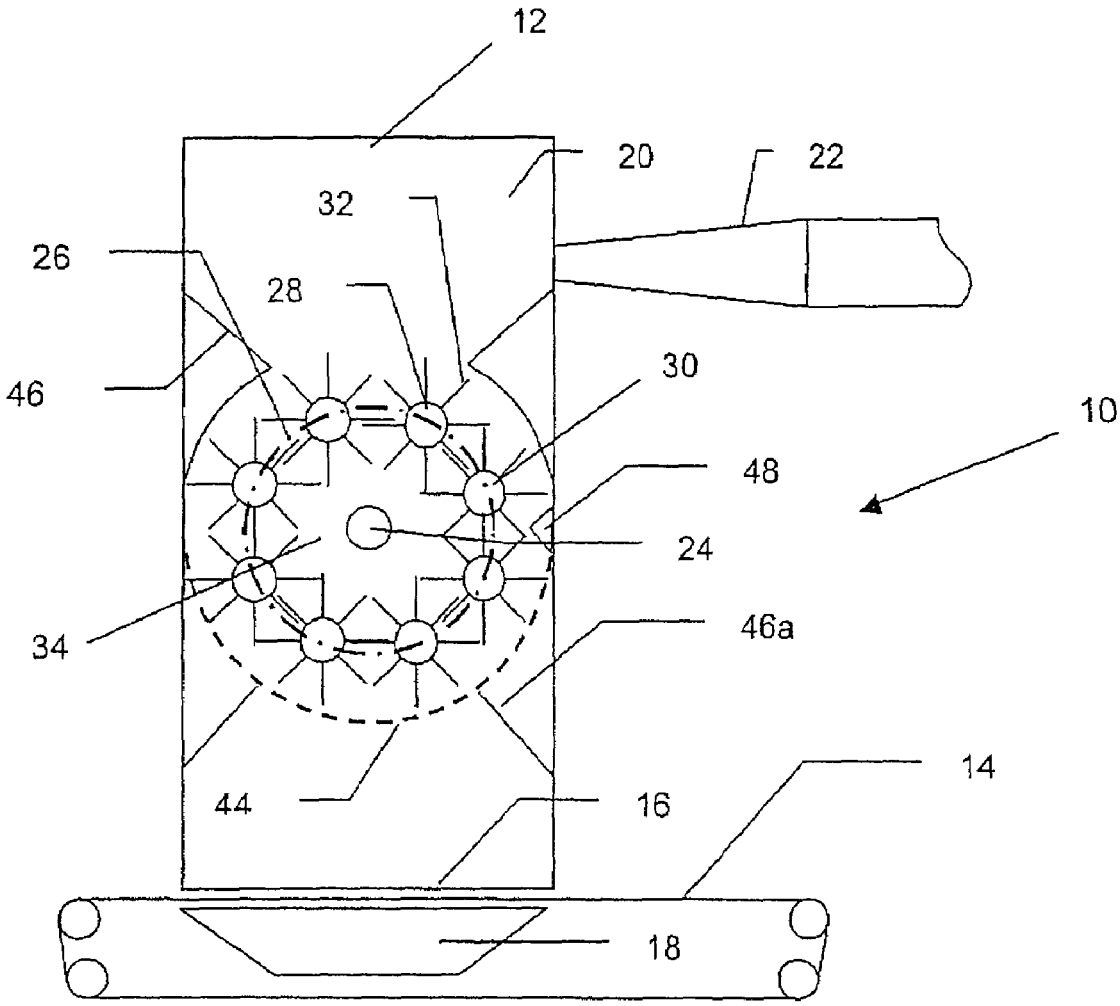
FIG. 1 shows a part of an installation for the production of a non-woven fabric with a forming head according to the invention.

The installation 10 shown in FIG. 1 for the production of a non-woven fabric includes a forming head 12 arranged above a conveyor belt 14. The conveyor belt 14 is air-permeable. The forming head 12 has a lower deposit opening 16 above the conveyor belt 14. A suction box 18 is arranged beneath the conveyor belt 14 and beneath the deposit opening 16.

A directed air flow can be produced by means of the suction box 18 through the forming head 12, out of the deposit opening 16, through the conveyor belt 14, and into the suction box 18.

Fibres which are deposited on the conveyor belt 14 by the forming head 12 can be securely sucked on to the conveyor belt 14 by means of the air flow. Fibres deposited on the conveyor belt 14 by the forming head 12 form a fibre bed (not shown) on the conveyor belt 14. By virtue of the fact that the conveyor belt 14 is continuously driven in circulation, a continuous fibre bed can be produced on the conveyor belt 14 if fibres are at the same time continuously deposited on the conveyor belt 14 by the forming head 12. That continuously produced fibre bed is fed to further processing stages (not further illustrated in FIG. 1), for example stages in which the fibre bed is then pressed.

Further subsequent joining procedures can be envisaged; they depend on the required properties of the product such as a small proportion of adhesive or a high level of tearing strength, even in the moist condition. Thus, besides water jet consolidation, application of high pressures at selected points and hydrogen bonding, mention may also be made of ultrasound bonding, bonding by heating, for example with hot air, or by the use of latex dispersions.

The fibres forming a respective fibre bed are usually natural fibres, for example cellulose fibres, mixed with synthetic fibres, for example so-called bi-component fibres. The latter preferably have a core of PET or PP and are enclosed with a sheath of PPE. Upon being heated the PE sheath melts and causes a respective bi-component fibre to be joined to a natural or synthetic adjacent fibre or functional constituents. Such functional constituents of the fibre bed, which are fed to the forming head 12, can be for example super-absorbent polymers (SAP) which provide that liquids can be efficiently bound by means of a non-woven fabric produced in that way. That property is particularly desirable when the non-woven fabric is to be subjected to further processing to provide absorbent articles such as diapers, sanitary towels or absorbent inserts.

Figure 2:
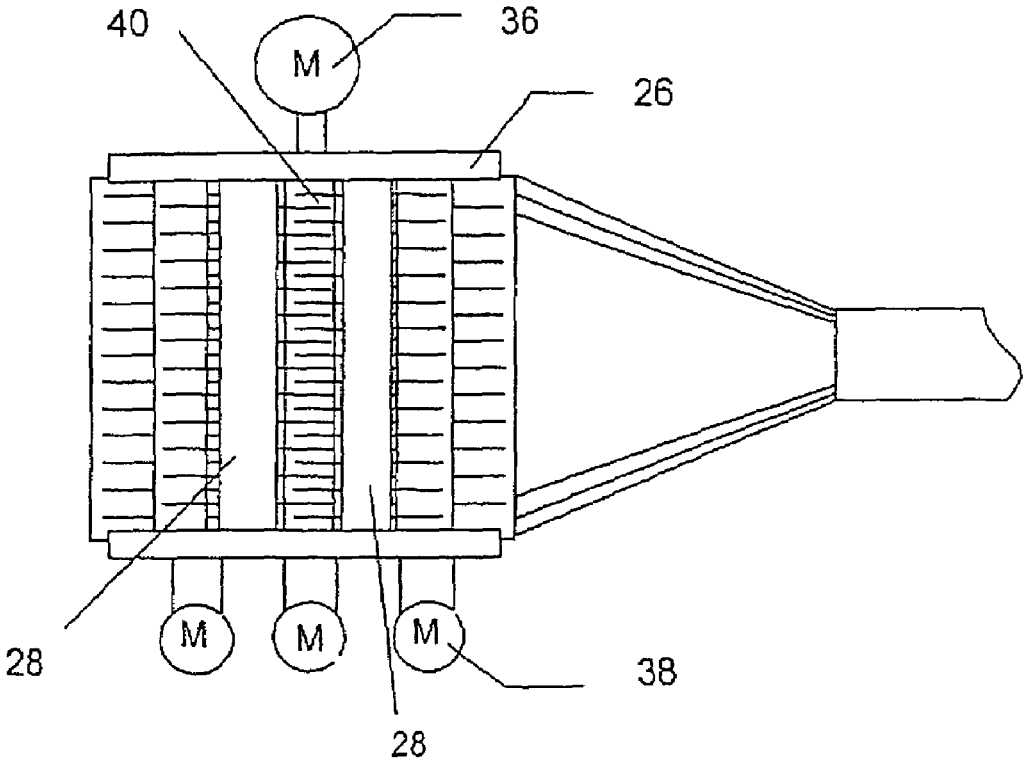
FIG. 2 shows a plan view of the forming head of FIG. 1.

The forming head 12 encloses a fibre processing chamber 20 into which open one or more fibre feed means 22—only one such fibre feed means 22 is shown in FIG. 1. With a plurality of fibre feed means, fibres of different kinds, for example cellulose fibres or bi-component fibres as well as further substances which are to be fed to the fibre bed such as SAP or odour-absorbent constituents can be fed independently of each other. The fibre feed means 22 provides for a uniform feed of pre-opened fibres over the entire width of the fibre processing chamber 20, see FIG. 2.

In a preferred variant, the fibre feed means provided is a volumetric metering unit which is arranged centrally above the fibre processing chamber 20, that is to say not laterally, as shown in the Figures. In the preferred variant therefore the fibre feed is from above into the fibre processing chamber.

Arranged in the fibre processing chamber 20 is a needle roller carrier 26 which is illustrated in FIG. 1 only by means of its central drive shaft 24 and which carries eight needle rollers 28 distributed uniformly on a notional cylindrical peripheral surface. The cylindrical peripheral surface of the needle roller carrier 26 is indicated by the dash-dotted line identified by reference 26. The needle roller carrier 26 can be better seen in FIG. 2.

Each of the needle rollers 28 has a needle roller body 30 with needles 32 which are fixed thereto and which are arranged in rows in the longitudinal direction of the needle roller body 30. The needles are of a diameter of between 1 and 6 mm and preferably between 2 and 4 mm. The spacing of the needles 32 from each other within a row is between 10 and 20 mm and is typically of the order of magnitude of 15 mm.

As shown in FIG. 1 the needle rollers 28 engage into each other and surround an inner chamber 34.

The needle roller carrier 26 is rotatable about its central shaft 24 in such a way that all of the needle rollers 28 are to be moved in a circular motion on the path indicated by the dash-dotted line. For that purpose the needle roller carrier 26 has a central electric drive motor 36.

Each needle roller 28 is driven by its own electric motor 38 so that the needle rollers 28 can be rotated independently of each other. As can be seen from FIG. 2, for that purpose the needles 32 of mutually adjacent needle rollers are arranged in mutually displaced relationship in the longitudinal direction of the needle rollers so that the needles 32 of adjacent needle rollers do not collide with each other when the needle rollers 28 rotate independently of each other.

Between the roller bodies 30 of adjacent needle rollers 28 there is a respective free space 40, into which the needles 32 of the adjacent needle rollers 28 project. Fibres which are fed in the fibre processing chamber 20 by means of the feed means 22 above the needle rollers 28 and thus above the inner chamber 34 must enter the inner chamber by passing through the respective free space 40 and thus between meshing needle rollers 28. Equally, fibres must leave the inner chamber 34 again by passing through one or more of the free spaces 40 between the adjacent needle rollers 28.

Fibres which are fed to the fibre processing chamber 20 above the inner chamber 34 by means of the fibre feed means 22 therefore must pass at least twice through the free spaces 40 between adjacent needle rollers 28 before the fibres leave the fibre processing chamber 20 in the region of the deposit opening 16. In doing that, the fibres pass through the inner chamber 34. In operation both the needle roller carrier 26 and also the respective needle rollers 28 are driven in rotation so that each needle roller 28 simultaneously performs a rotary movement and a translatory movement along the dash-dotted line.

Respectively adjacent needle rollers 28 are driven in mutually opposite directions of rotation so that, at the same rotary speed, they behave like meshing gears. For a respective free space 40, the result of this is that the needles 32 which project into the free space 40 predetermine a fibre transport direction which is either directed into the inner chamber 34 or out of same. In that way fibres can pass into the inner chamber 34 a plurality of times in the desired manner and can be conveyed out of same again before finally they leave the fibre processing chamber 20 through the deposit opening 16.

The number of 8 needle rollers, shown in FIG. 1, just like an alternatively possible number of 12 or 16 needle rollers, affords the advantage that the transport direction within diametrally opposite free spaces 40 is opposite, so that in the situation shown by way of example in FIG. 1, fibres are not transported through the upper free space into the inner chamber 34 and immediately leave the inner chamber 34 again through the lower free space.

To make the fibre bed which is to be produced by means of the forming head 12 uniform, a sieve 42 which is curved in a cylinder-like configuration is provided beneath the needle rollers 28. In the embodiment of the forming head which is preferred for processing longer fibres, that sieve is formed by a multiplicity of bars which extend parallel to the longitudinal axes of the needle rollers 28 and the axis of rotation of the needle roller carrier. Those bars are of a circular cross-section and are 2 cm in diameter. The spacing of the bars from each other is also 2 cm in each case. Such a sieve is suitable for fibres with a maximum fibre length (staple length) of about 40 mm. Those are fibre lengths as are usual in the case of cotton fibres and in the case of viscose staple fibres.

As mentioned hereinbefore it is also possible, for other types of fibres, to use sieves of conventional opening geometry, that is to say with round or oval holes or longitudinal slots.

The spacing of the sieve 42 from the free ends of the needles 32 is between 1 and 30 mm and preferably between 1 and 10 mm.

For making the stream of fibres still more uniform, the side walls of the fibre processing chamber 20, in the region identified by reference 46, are constricted inwardly so that this provides a constricted fibre entry opening above the needle rollers 28. The width thereof which can be seen in FIG. 1 approximately corresponds to 1.5 to 2.5 times the width of a respective free space 40 between mutually adjacent needle rollers 28. Similarly to the situation in the region 46 above the needle rollers 28 constricted side wall regions **46*a* can also be provided beneath the needle rollers 28**.

In addition the wedge-shaped configurations which remain between the possibly constricted side walls of the fibre processing chamber 20 and the needle rollers can be provided with fibre guide bodies 48 which restrict the free space between a respective side wall and the needle rollers. Those fibre guide bodies 48 are connected to the needle roller carrier 26 and rotate therewith. Similar fibre guide bodies can also be arranged on the central shaft 24.

The drawing does not show freely rotating rollers which are arranged at the underside of the side walls and which seal off the fibre processing chamber 20 beneath the sieve 42 with respect to the conveyor belt 14.

The following novel products can be manufactured with the above-described apparatus and the mode of operation thereof:

A Non-woven Fabric for the Production of Tampons

Tampons are formed at the present time as non-woven fabrics with long-fibre materials by means of a carding procedure, that is to say the fibres are deposited in the longitudinal direction with the forward advance direction of the endless deposited strips. In that situation, due to the directed form in which the fibres are deposited, an imbalance is formed in terms of tearing strength between the forward advance direction and transversely with respect thereto. The tearing strength is greater in the longitudinal direction than in the transverse direction.

The long fibres of up to 60 mm which are deposited by the processes described in this application provide for a different strength which is rendered uniform and which is improved for the area of use involved and which has positive effects on the tampon article.

For that purpose, the apparatus according to the invention uses the process according to the invention to produce a fibre bed of viscose fibres for tampons. Those fibres are either so-called trilobally shaped fibres or conventional round fibres or a mix of the two kinds of fibres. Typical fibre parameters are 1.7 to 6.7 dtex, of a length of between 20 and 60 mm. A typical weight in relation to surface area for a non-woven fabric for such a use is between 200 and 1000 g/m$^2$, depending on the respective type of tampon. Cotton fibres are sometimes used for non-woven fabrics of that kind for tampons. Those fibres can also be processed with the described apparatus and the described process. The definitive non-woven fabric can be composed of two or more layers. Each of those layers can contain fibres of differing specification. After the operation of forming the fibre bed, it is compacted with calender rollers and delivered in the form of rolls or blocks as an intermediate product for the manufacture of finished tampons.

Non-woven Fabrics for the Automobile Industry

The apparatus described herein and the process also make it possible to process flax fibres or hemp fibres or similar natural fibres in themselves or mixed with synthetic fibres. The fibre length of such natural fibres is typically 50 mm. As those fibres are a natural product however there are also those fibres which are shorter than 20 mm or longer than 120 mm. The synthetic fibres can be either polypropylene fibres or polyester fibres, the dtex values of which are between 1.7 and 20. The fibre length of the synthetic fibres is 12 to 38 mm for this example of product. The weight in relation to surface area of the corresponding non-woven fabrics is typically between 1200 and 2500 g/m$^2$.

Carrier Non-Woven Fabrics as Supports for Further Layers to be Deposited

It is also possible to produce carrier non-woven fabrics involving a weight in relation to surface area of 40 to 100 g/m$^2$. Fibres used here, besides the above-mentioned fibres, are synthetic binding fibres, in particular so-called bi-component fibres, whose dtex values are between 1.7 and 20. The fibre length of the synthetic binding fibres is 3 to 36 mm. The carrier non-woven fabrics can be the support for further layers to be deposited, with functional constituents, as they act as compacted carrier non-woven fabrics for fibres and/or constituents such as catch filters. For that purpose the carrier non-woven fabric is unwound on to the conveyor belt 14 and the fibres and/or functional constituents are deposited on the carrier non-woven fabric, instead of being deposited on to the conveyor belt.

Non-woven Fabrics for Hygiene Articles Such as Baby Diapers, Sanitary Towels, Incontinence Products and the Like In the case of the above-indicated hygiene articles, there is a side which faces towards the body. For that side use is made inter alia of special non-woven fabrics which rapidly transport the liquid into the subjacent absorbent core. A fibre bed which contains polyester fibres is produced for the manufacture of such absorption non-woven fabrics (referred to as the acquisition or intake layer). Those polyester fibres have dtex values of between 3.3 and 16.7 and are of a fibre length of between 24 and 36 mm. After the operation of forming the fibre bed the fibres are bound with styrene butadiene rubber (SBR) or with another binding agent such as EVA (ethylene vinyl acetate) or an acryl. A typical weight in relation to surface area for non-woven fabrics of that kind for hygiene articles is between 20 and 100 g/m$^2$.

Non-woven Fabrics for Use as Moist Cosmetic Skin Care Cloths

The described apparatus and the process can equally be used to produce a non-woven fabric which contains polypropylene fibres or polyester fibres with dtex values of between 1.0 and 3.3 as well as fibre lengths of between 24 and 38. For the purposes of liquid absorption, viscose fibres or fluffed-up wood cellulose pulp fibres (fluff pulp) can be mixed with the polypropylene or polyester fibres, either in the form of a uniform mix or in layers. In subsequent processing steps the non-woven fabric is water jet-consolidated or felted in some other fashion. In addition latex can be applied to one or both surfaces of the non-woven fabric to prevent it from giving off fluff.

The four product variations last described show the great range of variations in the non-woven fabrics which can be produced by means of the described forming head. Products of that kind are not to be produced with known air forming procedures and therefore themselves represent new (intermediate) products.

What is claimed is:

1. A forming head for an apparatus for the production of a non-woven fabric by depositing fibres on a conveyor belt, comprising a fibre feed means which opens into a fibre processing chamber which has a lower deposit opening for the delivery of fibres, wherein arranged in the fibre processing chamber are interengaging needle rollers with longitudinal axes oriented in mutually parallel relationship, which can rotate about their respective longitudinal axis, characterised in that the interengaging needle rollers (28) enclose an inner chamber (34), wherein the fibre feed means (22) is arranged outside the inner chamber (34) in such a way that fibres fed to the forming head (12) in operation must pass through between the interengaging needle rollers (28) into the inner chamber in the direction extending transversely with respect to the longitudinal axes of the needle rollers and must leave the inner chamber (34) also between the interengaging needle rollers (28) in a direction again extending transversely with respect to the longitudinal axes of the needle rollers, and wherein the longitudinal axes of the needle rollers are connected to a needle roller carrier which is driven in rotation and the axis of rotation of which extends parallel to the longitudinal axes of the needle rollers.

2. A forming head according to claim 1 characterised in that the longitudinal axes of the needle rollers are each at the same spacing relative to the axis of rotation of the needle roller carrier.

3. A forming head according to claim 1 characterised in that the longitudinal axes of the needle rollers are each at the same spacing from each other.

4. A forming head according to claim 1 characterised in that a sieve is arranged beneath the needle rollers and associated with the deposit opening.

5. A forming head according to claim 4 characterised in that the sieve is arranged in a cylinder wall segment-like configuration beneath the inner chamber.

6. A forming head according to claim 4 characterised in that the sieve is shaped in the manner of a cylindrical wall segment of a cylinder, the centre line of the cylinder at least approximately coinciding with the axis of rotation of the needle roller carrier.

7. A forming head according to claim 4 characterised in that the sieve is formed by sieve bars extending at least approximately parallel to the longitudinal axes of the needle rollers.

8. A forming head according to claim 7 characterised in that the sieve bars are of a round cross-section.

9. A forming head according to claim 7 characterised in that the sieve bars are of a diameter which is matched to the length of the fibres to be processed, in such a way that the diameter approximately corresponds to half the length of the longest fibres to be processed.

10. A forming head according to claim 7 characterised in that the sieve bars are at a spacing from each other which is matched to the length of the fibres to be processed, in such a way that the spacing of the sieve bars from each other approximately corresponds to half the length of the longest fibres to be processed.

11. A forming head according to claim 1 characterised in that the fibre processing chamber is laterally closed in the region of the needle rollers by side and end walls in such a way that the end walls extend across the inner chamber transversely with respect to the longitudinal direction of the needle rollers while the side walls extend parallel to the longitudinal axes of the needle rollers, wherein the end and side walls are so arranged with respect to the needle rollers that fibres are very substantially prevented from flowing past the inner chamber enclosed by the needle rollers.

12. A forming head according to claim 11 characterised in that the side walls above the needle rollers are curved towards each other in such a way as to extend to close to the needle rollers so that a fibre entry opening is provided above the needle rollers.

13. A forming head according to claim 12 characterised in that the needle rollers have a closed roller body and needles which project therefrom so that a respective free space is provided between the roller bodies of adjacent needle rollers, wherein the fibre entry opening is approximately 1.5 to 2.5 times as large as the free space between the roller bodies of directly adjacent needle rollers.

14. A forming head according to claim 1 characterised in that, distributed over their respective periphery, the needle rollers have a plurality of rows, extending along the longitudinal axis of the needle roller, of radially projecting needles which, in the case of adjacent interengaging needle rollers, are arranged displaced along the respective row in the longitudinal direction with respect to the adjacent needle roller in such a way that the interengaging needle rollers can rotate independently of each other.

15. A forming head according to claim 1 characterised in that, distributed over their respective periphery, the needle rollers have a plurality of rows, extending along the longitudinal axis of the needle roller, of radially projecting needles which within a respective row are arranged displaced alternately in the peripheral direction of the needle roller, thereby affording a respective needle row of a zig-zag configuration.

16. A forming head according to claim 1 characterised in that the inner chamber is enclosed by eight or twelve needle rollers.

17. A forming head according to claim 1 characterised in that each needle roller has its own drive motor, preferably a respective electric motor.

18. A forming head according to claim 1 characterised in that the needle roller carrier has a shaft extending centrally through the inner chamber.

* * * * *